US005698380A

United States Patent [19]

Toya

[11] Patent Number: 5,698,380

[45] Date of Patent: Dec. 16, 1997

[54] METHOD OF FORMING IMAGES

[75] Inventor: Ichizo Toya, Minami-Ashigara, Japan

[73] Assignee: Fuji Photo Film Co., Ltd., Kanagawa, Japan

[21] Appl. No.: 551,810

[22] Filed: Nov. 7, 1995

[30] Foreign Application Priority Data

Nov. 7, 1994 [JP] Japan ..... HEI 6-272259

[51] Int. Cl.$^6$ ..... G03C 1/498

[52] U.S. Cl. ..... 430/363; 430/584; 430/604; 430/617; 430/619; 430/944; 430/945

[58] Field of Search ..... 430/363, 944, 430/567, 619, 945, 604, 568, 617, 584

[56] References Cited

U.S. PATENT DOCUMENTS 5,264,338 11/1993 Urabe et al. ..... 430/568
5,427,901 6/1995 Arakatsu et al. ..... 430/505
5,468,603 11/1995 Kub ..... 430/619

FOREIGN PATENT DOCUMENTS 0 179 555 3/1988 European Pat. Off. .
59-130494 7/1984 Japan .

*Primary Examiner*—Thorl Chea
*Attorney, Agent, or Firm*—Sughrue, Mion, Zinn, Macpeak & Seas, PLLC

[57] ABSTRACT

A method for forming an image, which comprises a step of subjecting a light-sensitive material to exposure to laser light having a multi-longitudinal-mode, wherein the light-sensitive material comprises a support having provided thereon at least one layer containing light-sensitive silver halide grains having an average grain size of no greater than 0.2 μm, and the light-sensitive silver halide grains have a coverage rate of no greater than 1 g/m$^2$, based on silver.

9 Claims, No Drawings

METHOD OF FORMING IMAGES

FIELD OF THE INVENTION

The present invention relates to an image formation method using a silver halide photographic light-sensitive material (hereinafter sometimes referred to "light-sensitive material"), which has excellent processability and image quality, and does not cause uneven density due to interference fringe.

BACKGROUND OF THE INVENTION

As a method for lessening the interference-fringe influence in a light-sensitive material suitable for exposure to laser light, there has hitherto been known the method described in JP-B-06-10735 (corresponding to EP 179555 B; the term "JP-B" as used herein means an "examined Japanese patent publication"). This method, however, does not bring results satisfactory to the image formation using a light-sensitive material which has excellent processability and image quality. Thus, it becomes necessary to find a suitable method for the solution of the aforementioned problem.

SUMMARY OF THE INVENTION

An object of the present invention is to provide a method for forming an image using a silver halide photographic light-sensitive material, which has excellent processability and image quality without accompanied by the uneven density problem arising from interference fringe.

As a result of our intensive studies on the foregoing problem, it has been found that the above-described object can be attained by a method of forming images which comprises a step of subjecting a light-sensitive material to exposure to laser light having a multi-longitudinal-mode, wherein the light-sensitive material comprises a support having provided thereon at least one layer containing light-sensitive silver halide grains having an average grain size of no greater than 0.2 μm, and the silver halide grains have a coverage rate of no greater than 1 g/m$^2$, based on silver.

DETAILED DESCRIPTION OF THE INVENTION

For the light-sensitive material used in the present invention, a suitable coverage rate of the silver halide grains is not greater than 1 g/m$^2$, preferably not greater than 0.2 g/m$^2$, on a silver basis. As for the average grain size of the light-sensitive grains, it is more desirable to be not greater than 0.1 μm.

The term "multi-longitudinal-mode" used in the present invention refers to a mode in which laser light has plural spectra. To this mode are applicable the method of superimposing high frequency waves one upon another as described, e.g., in JP-A-59-130494 (the term "JP-A" as used herein means an "unexamined published Japanese patent application"), the laser diode described in *DATA BOOK* 1992 published by Sony Corporation, and the multi-longitudinal-mode described in '93 *Data Book*, published by Mitsubishi Electric Corp. The wavelength of the laser light is not limited, but preferred is a red to infrared laser (more preferably having a maximum wavelength of 700 to 900 nm).

For the photographic processing adopted in the present invention, it is desirable to use a processing solution in a volume of no greater than 520 ml, preferably no greater than 250 ml, per m$^2$ of a light-sensitive material. In particular, the processing in which no processing solution is used in a substantial sense is favorable to the present invention.

The processing system using a processing solution in a slight or substantially zero amount is useful from the ecological point of view. In order to fit a light-sensitive material to such processing, it is advantageous that the coverage rate of light-sensitive grains is lowered on a silver basis as mentioned above. However, lowering of the silver coverage leads to reduction in the number of photosensitive elements, whereby an image quality, or graininess, is impaired.

For the light-sensitive silver halide emulsions to constitute the present light-sensitive material, it is preferable to undergo spectral sensitization in a wavelength region of from red to infrared radiation.

In order to make the light-sensitive emulsion layer show the maximum spectral sensitivity at wavelengths of no shorter than 700 nm, it is effective to use sensitizing dye(s) represented by the following formulae (Ia), (Ib) or (Ic):

(Ia)

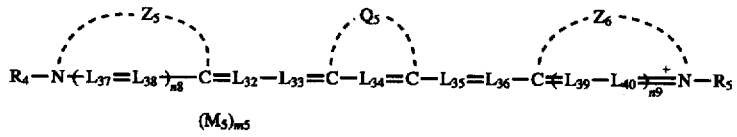

(Ib)

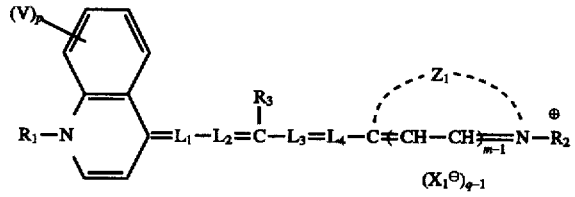

(Ic)

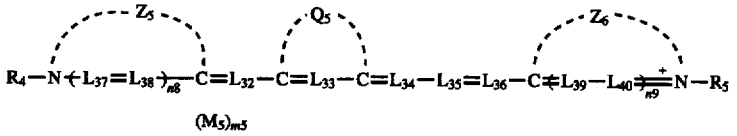

Firstly, the foregoing formulae (Ia) and (Ic) are described.

$Z_5$ and $Z_6$ each represents an atomic group necessary for forming a 5- or 6-membered nitrogen-containing heterocyclic ring.

$Q_5$ represents an atomic group necessary for forming a 5-, 6- or 7-membered ring.

$R_4$ and $R_5$ each represents an alkyl group.

$L_{32}$, $L_{33}$, $L_{34}$, $L_{35}$, $L_{36}$, $L_{37}$, $L_{38}$, $L_{39}$ and $L_{40}$ each represents an unsubstituted or substituted methine group. In addition, any one of them may form a ring together with another methine group or an auxochrome.

$n_8$ and $n_9$ are each 0 or 1.

$M_5$ represents a counter ion for charge neutralization; and ms is the number of counter ion(s) required for neutralization of intramolecular charges, which is not smaller than 0.

Secondly, the foregoing formula (Ib) is described.

$R_1$ and $R_2$ are the same or different, and each of them represents an alkyl group. $R_3$ represents a hydrogen atom, a lower alkyl group, a lower alkoxy group, a phenyl group, a benzyl group or a phenetyl group.

$L_1$, $L_2$, $L_3$ and $L_4$ are each an unsubstituted or substituted methine group. In addition, $L_2$ and $L_3$ may combine with each other to complete a ring.

V represents a hydrogen atom, a lower alkyl group, an alkoxy group, an alkylthio group, a halogen atom, or a substituted alkyl group. $Z_1$ represents a nonmetallic atomic group necessary for completing a 5- or 6-membered nitrogen-containing heterocyclic ring. $X_1$ represents an acid anion. m, p and q independently represent 1 or 2. However, q is 1, provided that the dye forms an inner salt.

As specific examples of compounds represented by general formulae (Ia), (Ib) and (Ic), mention may be made of Compounds A-1 to A-14 and Compounds B1 to B25 exemplified in JP-A-7-13289 and the compound marked as [Ka 13] in the same application.

The compounds represented by formula (Ia) or (Ic) can be synthesized according to the methods described in certain literatures, e.g., *Zh. Org. Khim.*, vol. 17, No. 1, pp. 167–169 (1981), vol. 15, No. 2, pp. 400–407 (1979), vol. 14, No. 10, pp. 2214–2221 (1978), vol. 13, No. 11, pp. 2440–2443 (1977), and vol. 19, No. 10, pp. 2134–2142 (1983); *Ukr. Khim. Zh.*, vol. 40, No. 6, pp. 625–629 (1974); *Khim. Geterotsikl. Soedin.*, No. 2, pp. 175–178 (1976); Russian Patents 420,643 and 341,823; JP-A-59-217761; U.S. Pat. Nos. 4,334,000, 3,671,648, 3,623,881 and 3,573,921; EP-A1-0288261; EP-A2-0102781; and JP-B-49-46930.

The compounds represented by formula (Ib) can be synthesized by reference to the methods described in JP-A-59-192242 and U.S. Pat. No. 4,975,362.

These sensitizing dyes may be used individually or in combination. Combinations of sensitizing dyes are often employed for the purpose of supersensitization. Dyes having no spectral sensitization effect by themselves or materials showing no absorption in the visible region may also be incorporated into the silver halide emulsions, provided that they can exhibit a supersensitizing effect when used in combination with those sensitizing dyes.

Useful sensitizing dyes, typical supersensitizing combinations and materials capable of exhibiting a supersensitizing effect are described, e.g., in *Research Disclosure*, Vol. 176, No. 17643, p. 23, item IV-J (Dec., 1978), JP-B-49-25500, JP-B-43-4933, JP-A-59-19032, JP-A-59-192242, JP-A-03-15049 and JP-A-62-123454.

The present sensitizing dyes, which can provide light-sensitive emulsions with the maximum spectral sensitivity at a wavelength of no shorter than 700 nm, are used in an amount of from $10^{-7}$ to $1\times^{-2}$ mole, particularly $10^{-6}$ to $5\times10^{-3}$ mole, per mole of silver halide.

Silver halides present in the silver halide emulsions used in this invention may be any of silver chloride, silver bromide, silver iodobromide, silver chlorobromide and silver chloroiodobromide. The iodide content therein is desirable to be not more than 2 mole %, preferably not more than 1 mole %.

The average grain size of the silver halides used in the present invention is not greater than 0.2 μm, preferably 0.0001 μm to 0.2 μm, more preferably 0.001 μm to 0.1 μm, and it can be attained by properly controlling the temperature, pAg, pH and addition flow rate and using appropriate additives at the time of emulsion-making. The lower limit of the average grain size is 0.0001 μm.

The crystal form of silver halide grains used in the present invention may be any of a cube, an octahedron, a tetradecahedron, a plate and a sphere, or a composite of those various forms. However, it is preferable for the silver halide grains to have a cubic, tetradecahedral or tabular crystal form.

The silver halide grains are preferably monodisperse with respect to size distribution (distribution coefficient: 15% or below). Further, the grains may have the interior and the surface which are different in halide composition, that is, the so-called core/shell structure.

The silver halide grains have a coverage rate of no greater than 1 g/m$^2$, preferably 0.005 g/m$^2$ to 1 g/m$^2$, more preferably 0.005 g/m$^2$ to 0.2 g/m$^2$, based on silver. The lower limit of the coverage rate of the silver halide grains is 0.005 g/m$^2$, based on silver.

A water-soluble iridium compound can be used in the present invention. As examples of such a compound, mention may be made of Ir(III) halides, Ir(IV) halides, and iridium complex salts having halogeno, ammine or oxalato ligands, such as hexachloroiridium(III) or (IV) complex salts, hexaammineiridium(III) or (IV) complex salts, and trioxalatoiridium(III) or (IV) complex salts. Also, it is possible to use a mixture of Ir(III) and Ir(IV) compounds arbitrarily chosen from the above-cited ones. Those iridium compounds are used in the form of solution in water or an appropriate solvent. In order to stabilize the solution of iridium compound, a conventional method of adding an aqueous solution of hydrogen halogenide (e.g., hydrochloric acid, hydrobromic acid, hydrofluoric acid) or an alkali halogenide (e.g., KCl, NaCl, KBr, NaBr) can be adopted. In spite of using a water-soluble iridium compound, it is possible to adopt a method of adding iridium-doped silver halide grains to an emulsion-making system during the formation of intended silver halide grains, thereby dissolving iridium into the system.

The total addition amount of iridium compounds for use in the present invention is not less than $10^{-8}$ mole, preferably from $1\times10^{-8}$ to $1\times10^{-5}$ mole, most preferably from $5\times10^{-8}$ to $5\times10^{-6}$ mole, per mole of finally formed silver halide.

The addition of those compounds can be done at any stage during the preparation of a silver halide emulsion or before the application of the emulsion, if desired. In particular, it is advantageous to add them at the stage of grain formation, thereby incorporating them into silver halide grains. Further, a compound containing a Group VIII atom other than iridium may be used in combination with an iridium compound as cited above.

The light-sensitive material prepared in the present invention contains water-soluble dyes in hydrophilic colloid layers for various purposes, e.g., as a filter dye, for the prevention of irradiation, and so on. Examples of such dyes include oxonol dyes, hemioxonol dyes, styryl dyes, merocyanine dyes, cyanine dyes and azo dyes. Of these dyes, oxonol dyes, hemioxonol dyes, cyanine dyes and merocyanine dyes are used to greater advantage.

As for the anti-halation dyes which can be used in the present invention, suitable examples thereof are the indoaniline dyes described in JP-A-62-3250 and JP-A-02-259753, the indoaniline complex dyes described in JP-A-01-253734, the oxonol dyes described in JP-A-01-227148 and JP-A-03-9346, the cyanine dyes described in JP-A-01-147539, JP-A-02-5041, JP-A-02-108040, JP-A-02-187751, JP-A-01-297647, JP-A-01-280750, JP-A-03-235940, JP-A-04-45438 and European Patent 288,076, and the merocyanine dyes described in JP-A-01-25373.

It is preferable for the light-sensitive materials used in the present invention to be rendered heat-developable by the combined use of silver halide grains with the silver salt of a long-chain fatty acid, an organic reducing agent, a toning agent and so on.

The light-sensitive materials forming photographic images using such a heat-development process are known by being disclosed, for example, in U.S. Pat. Nos. 3,152,903 and 3,457,075 and D. Morgan and B. Shely, *Thermally processed Silver Systems*, (Imaging Processes and Materials, Neblette, 8th Edition, edited by Sturge, V. Wlaworth, and A. Shepp, page 2, 1060. Such a light-sensitive material contains a long-chain fatty acid silver salt as a reducible silver source, a catalytic active amount of silver halide grains as a photocatalyst, a toning agent for controlling the tone of silver, and an organic reducing agent in the state of being dispersed in usually in a (organic) binder matrix. The light-sensitive material is stable at normal temperature but when the light-sensitive is heated to a high temperature (e.g., at least 80° C.) after exposure, silver is formed through the oxidation reduction reaction between the reducible silver source (functions as an oxidizing agent) and the organic reducing agent. The oxidation reduction reaction is accelerated by the catalytic action of the latent images formed by the light exposure. Silver formed by the reaction of the organic silver salt in the light-exposed region provides black images, whereby images are formed by the contrast with unexposed regions.

As examples of the silver salt of a long-chain fatty acid which can be employed in the present invention, mention may be made of the silver salts of $C_8$–$C_{26}$ fatty acids containing a terminal carboxylic acid. Examples thereof include silver salts of gallic acid, behenic acid, stearic acid, palmitic acid, lauric acid and oxalic acid, and preferably silver salts of behenic acid and stearic acid.

The silver salt of the long-chain fatty acid for use in the present invention can be synthesized according to the methods described, e.g., in U.S. Pat. Nos. 3,457,075, 3,839,049, 3,458,544, 2,910,377, 3,700,458, 3,761,273, 3,706,565, 3,706,564 and 3,713,833, British Patents 1,347,350, 1,405,867, 1,362,970 and 1,354,186, JP-A-49-94619, JP-A-53-31611, JP-A-50-32926, JP-A-50-17216, JP-B-43-4924 and JP-B-43-4921.

The silver salt of the long-chain fatty acid for use in the present invention may be used in an amount of 0.1 to 3 g/m$^2$, preferably 0.5 to 2 g/m$^2$, based on silver.

As for the organic reducing agent usable in the present invention, the compounds described, e.g., in JP-A-46-6074, JP-B-53-2323, JP-B-51-35851, JP-B-53-9753, JP-A-51-51933, JP-A-52-84727, JP-A-50-36110 and JP-A-50-116023 are examples thereof.

Suitable examples of the reducing agent are described in U.S. Pat. Nos. 3,770,448, 3,773,512, and 3,593,863, and Research Disclosure Nos. 17029 and 29963 and there are aminohydroxychloroalkenone compounds (e.g., 2-hydroxypiperidino-2-cyclohexenone); aminoreductone esters as the precursors as a developing agent (e.g., piperidinohexosereductone monoacetate); N-hydroxyurea derivatives (e.g., N-p-methylphenyl-N-hydroxyurea); hydrazones of aldehyde or ketone (e.g., anthracene aldehyde phenylhydrazone); phosphamidophenols; phosphamidoanilines; polyhydroxybenzenes (e.g., hydroquinone, t-butylhydroquinone, isopropylhydroquinone, and 2,5-dihydroxyphenyl)methylsulfone; sulfhydroxamic acids (e.g., benzenesulfhydroxamic acid); sulfonamidoanilines (e.g., 4-(N-methanesulfonamido)aniline); 2-tetrazorylthiohydroquinones (e.g., 2-methyl-5-(1-phenyl-5-tetrazolylthio)hydroquinone); tetrahydroquinoxalines (e.g., 1,2,3,4-tetrahydroquinoxaline); amidoxines; azines (e.g., combinations of aliphatic carboxylic acid arylhydrazides and ascorbic acid); a combination of polyhydroxybenzene and hydroxylamine; reductones and/or hydrazine; hydroxamic acids; combinations of azines and sulfonamidophenols; α-cyanophenylacetic acid derivatives; combinations of bis-β-naphthol and 1,3-dihydroxybenzene derivatives; 5-pyrazolones; sulfonaidophenol reducing agents; 2-phenylidane-1,3-diones; chroman; 1,4-dihydropyridines (e.g., 2,6-dimethoxy-3,5-dicarboethoxy-1,4-dihydropyridine); bisphenols (e.g., bis(2-hydroxy-3-t-butyl-5-methylphenyl)methane, bis(6-hydroxy-m-tri)mesitol, 2,2-bis(4-hydroxy-3-methylphenyl)propane, and 4,4-ethylidene-bis(2-t-butyl-6-methyl)phenol); ultraviolet-sensitive ascorbic derivatives and 3-pyrazolidones.

Preferred reducing agents are hindered phenols represented by formula (A)

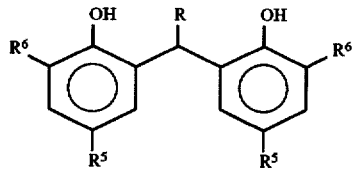

(A)

wherein R represents a hydrogen atom or an alkyl group having from 1 to 10 carbon atoms (e.g., —$C_4H_9$ and 2,4,4-trimethylpentyl) and $R^5$ and $R^6$ each represents an alkyl group having from 1 to 5 carbon atoms (e.g., methyl, ethyl, and t-butyl).

As for the toning agent usable in the present invention, the compounds described, e.g., in JP-A-46-6077, JP-A-49-91215, JP-A-50-2524, JP-A-52-33722 and JP-B-52-5845 are examples thereof.

The suitable binder is transparent or translucent, and generally colorless and there are natural polymers, synthetic resins, polymers, copolymers, and other media for forming films. For example, there are gelatin, gum arabic, poly(vinyl alcohol), hydroxyethyl cellulose, cellulose acetate, cellulose acetate butyrate, poly(vinylpyrrolidone), casein, starch, poly (acrylic acid), poly(methyl methacrylate), poly(vinyl chloride) poly(methacrylic acid), copoly(styrene-maleic anhydride), copoly(styrene-acrylonitrile), copoly(styrene-butadiene), poly(vinyl acetals) (e.g., poly(vinyl formal) and poly(vinyl butyral), poly(esters), poly(urethanes), a phenoxy resin, poly(vinylidene chloride), poly(epoxides), poly (carbonates), poly(vinyl acetate), cellulose esters, and poly (amides). The binder may be formed by coating from a solution in water or an organic solvent, or an emulsion.

Examples of the suitable toning agent are disclosed in Research Disclosure No. 17029 and there are imides (e.g., phthalimide); cyclic imides; pyrazolin-5-ones and quinazolinone (e.g., succinimide, 3-phenyl-2-pyrazolin-5-one, 1-phenylurazole, quinazoline, and 2,4-thiazolidinedione); naphthalimides (e.g., N-hydroxy-1,8-naphthalimide); cobalt complexes (e.g., hexamine trifluoroacetate of cobalt), mercaptans (e.g., 3-mercapto-1,2,4-triazole); N-(aminomethyl) aryldicarboxyimides (e.g., N-(dimethyl-aminomethyl) phthalimide); blocked pyrazoles; combinations of isothiuronium derivatives and certain light bleaching agents (e.g., a combination of N,N'-hexamethylene(1-carbamoyl-3, 5-dimethylpyrazole), 1,8-(3,6-dioxaoctane)bis (isothiuronium trifluoroacetae), and 2-(tribromomethylsulfonyl)benzothiazole); merocyanine dyes (e.g., 3-ethyl-5-((3-ethyl-2-benzothiazolinylidene)-1-methylethylidene)-2-thio-2,4-oxazolidinedione); phthalazinone, phthalazinone derivatives or the metal salts of these derivatives (e.g., 4-(1-naphthyl)phthalazinone, 6-chlorophthalazinone, 5,7-dimethyloxyphthalazinone, and 2,3-dihydro-1,4-phthalazinedione); phthalazone; combinations of phthalazinone and sulfinic acid derivatives (e.g., a combination of 6-chlorophthalazinone and sodium benzenesulfinate, and a combination of 8-methylphthalazinone and sodium p-trisulfonate); a combination of phthalazine and phthalic acid; a combination of phthalazine (including an addition product of phthalazine), maleic anhydride and at least one compound selected from phthalic acid, 2,3-naphthalenedicaroboxylic acid or o-phenylenic acid derivatives and the anhydrides thereof (e.g., phthalic acid, 4-methylphthalic acid, 4-nitrophthalic acid, and tertachlorophthalic anhydride); quinazolinediones; benzoxazine; orthoxazine derivatives; benzoxazine-2,4-diones (e.g., 1,3-benzoxazine-2,4-dione), pyrimidines and asymmetrytriazines (e.g., 2,4-dihydroxypyrimidine) and tetrazapentalene derivatives (e.g., 3,6-dimercapto-1,4-diphenyl-1H,4H-2,3a,5,6a-tetrazapentalene.

The preferred toning agent is phthalazone or phthalazine:

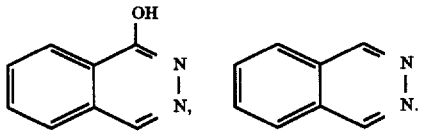

An organic reducing agent or toning agent in a state of solid fine particles can be prepared mechanically with a known means for fine grinding (e.g., a ball mill, a vibrating ball mill, a planetary ball mill, a sand mill, a colloid mill, a jet mill, a roller mill) in the presence of a dispersing agent and, if necessary, an appropriate solvent (e.g., water, an alcohol). Also, any of the compounds cited above can be shaped into fine particles using another method, e.g., the method of dissolving such a compound in an appropriate solvent in the presence of a surfactant for dispersion and then adding the resulting solution to a poor solvent for the compound, thereby precipitating the compound in a finely divided form, or the method of dissolving such a compound by pH control and then changing the pH to deposit it as fine particles. The thus formed fine particles of the foregoing compound is dispersed into an appropriate binder to prepare a solid dispersion of nearly uniform particles, and coated on a given support to provide a layer containing the foregoing compound.

As for the average particle size of the foregoing compound in the solid dispersion, it is desirable to be not greater than 10 μm, and more desirable to be from 0.01 μm to 6 μm.

The photographic materials used in the present invention have no particular restrictions as to, e.g., additives, and thereto are applicable those described in the following patent specifications.

| Items | References |
|---|---|
| 1) Silver halide emulsions and Preparation methods | JP-A-02-68539, p. 8, right lower column, line 6, to p. 10, right upper column, line 12; JP-A-03-24537, p. 2, right lower column, line 10, to p. 6, right upper column, line 1, and p. 10, left upper column, line 16, to p. 11, left lower column, line 19; and JP-A-4-107442. |
| 2) Chemical sensitization | JP-A-02-68539, p. 10, right upper column, line 13, to left upper column, line 16; and JP-A-5-313282. |
| 3) Antifoggants and Stabilizers | JP-A-02-68539, p. 10, left lower column, line 17, to p. 11, left upper column, line 7, and p. 3, left lower column, line 2, to p. 4, left lower column. |
| 4) Tone improvers | JP-A-62-276539, p. 2, left lower column, line 7, to p. 10, left lower column, line 20; and JP-A-03-94249, p. 6, left lower column, line 15, to p. 11, right upper column, line 19. |
| 5) Spectral sensitizing dyes | JP-A-02-68539, p. 4, right lower column, line 4, to p. 8, right lower column. |
| 6) Surfactants and Antistatic agents | JP-A-02-68539, p. 11, left upper column, line 14, to p. 12, left upper column, line 9. |
| 7) Matting agents, Slipping agents and Plasticizers | JP-A-02-68539, p. 12, left upper column, line 10, to right upper column, line 10, and p. 14, left lower column, line 10, to p. 14, right lower column, line 1. |
| 8) Hydrophilic colloids | JP-A-02-68539, p. 12, right upper columns, line 11, to p. 12, left lower column, line 16. |
| 9) Hardeners | JP-A-02-68539, p. 12, left lower column, line 17, to p. 13, right upper column, line 6. |
| 10) Supports | JP-A-02-68539, p. 13, right upper column, lines 7 to 20. |
| 11) Crossover cut methods | JP-A-02-264944, p. 4, right upper column, line 20, to p. 14, right upper column. |
| 12) Dyes and Mordants | JP-A-02-68539, p. 13, left lower column, line 1, to p. 14, left lower column, line 9; JP-A-03-24537, p. 14, left lower column, to p. 16, right lower column. |
| 13 Polyhydroxybenzenes | JP-A-03-39948, p. 11, left upper column, to p. 12, left lower column; and EP-A-0452772. |
| 14) Layer structures | JP-A-03-198041. |

In the present invention, heat development after the exposure may be conducted under the following conditions. Preferred heat development temperature is from 80° C. to 140° C., more preferably from 100° C. to 130° C. Preferred heat development time is from 1 sec. to 40 sec., more preferably 3 sec. to 30 sec. The heat development may be preferably conducted by contacting the light-sensitive material with a heat drum or by radiating the light-sensitive material with far infrared radiation.

The present invention will now be illustrated in more detail by reference to the following examples.

EXAMPLE 1

1. Preparation of Light-sensitive Silver Halide Emulsions 1 and 1A

Gelatin in the amount of 20 g was added to 800 ml of distilled water, dissolved therein at 35° C., and then adjusted to pH 3.8 with citric acid. Thereto were added 2.8 g of sodium chloride and 0.2 ml of a 1% water solution of N,N-dimethylimidazoline-2-thione. The resulting solution was further admixed with a solution containing 100 g of silver nitrate in 314 ml of distilled water and a solution containing 36.2 g of sodium chloride and $K_2IrCl_6$ in the amount of $10^{-6}$ mole per mole of silver halide to be produced in 314 ml of distilled water.

After 2-minute lapse, a solution containing 60 g of silver nitrate in 186 ml of distilled water and a solution containing 21.5 g of sodium chloride in 186 ml of distilled water were further added over a 9.5-minute period to the aforementioned solution with stirring under a temperature of 40° C., thereby forming the core part of the desired silver halide grains. Thereto, a solution containing 40 g of silver nitrate in 127 ml of distilled water and a solution containing 11.9 g of sodium chloride, 5.7 g of potassium bromide and $K_4Fe(CN)_6 \cdot 3H_2O$ in the amount of $1\times10^{-5}$ mole per mole of silver halide to be produced in 127 ml of distilled water were further added with stirring over a 6.5-minute period under a temperature of 40° C. to form the shell part. The thus prepared emulsion was named Emulsion 1.

As a result of the observation under an electron microscope, Emulsion 1 was found to comprise cubic silver bromochloride grains having a grain size of 0.15 μm (the term "grain size" as used herein refers to the average diameter of the circles having the same areas as the projected areas of individual grains) and a variation coefficient of 10% with respect to the grain size distribution.

After a desalting treatment, the Emulsion 1 was admixed with 100 g of gelatin, 100 mg of Proxel, 1.7 g of phenoxyethanol and 0.15 g of nucleic acid, and adjusted to pAg 7.7 with sodium chloride. Then, the resulting emulsion was chemically sensitized at 60° C. in the following manner: The emulsion was admixed with 43 mg of sodium thiosulfonate, allowed to stand for 5 minutes, admixed with 8.7 mg of sodium thiosulfate, once more allowed to stand for 5 minutes, admixed with 18.8 mg of chloroauric acid, ripened for 60 minutes, and then solidified by rapid quenching as 0.38 g of 4-hydroxy-6-methyl-1,3,3a,7-tetrazaindene was added thereto. The thus obtained emulsion was named Emulsion 1A.

2. Preparation of Light-Sensitive Silver Halide Emulsions 2 to 4 and 2A to 4A Three other couples of Emulsions were prepared in the same manner as the foregoing couple of Emulsions 1 and 1A, except that the grain growth was carried out at different temperatures.

3. Preparation of Coated Samples

Layer A;

| | |
|---|---|
| Gelatin | 1 g/m² |
| Dye I-1 illustrated below | 20 mg/m² |

<Preparation of Dispersion of Dye I-1>

2.5 of Dye I-1 , 10.3 g of a 4.3% of surfactant (Triton X-200, trade mark, a product of Rohm & Hass Co., Ltd.) and 50.5 g of water were mixed with stirring. The resulting mixture was placed in an Eiger Motor Mill (M-50, made by Eiger Japan Co.) in which 40 cc of zirconia beads measuring from 0.8 mm to 1.2 mm in diameter were kept, and dispersed at 5,000 r.p.m. to prepare a dispersion of microcrystalline dye having a grain size of no greater than 1 μm. A 50 g portion of the thus prepared dispersion, 1.8 g of gelatin and 13.3 g of water were mixed at 40° C. with stirring, and used for the preparation of the photosensitive materials relating to the present invention.

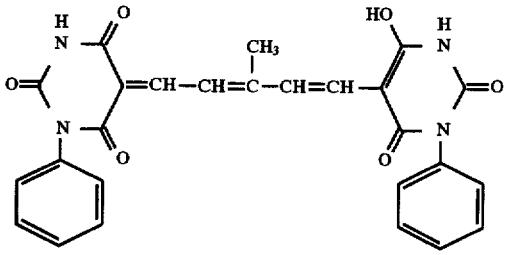

Dye I-1

Layer B; Light-sensitive Layer

The following ingredients were added to Emulsion 1A in their respective amounts set forth below per mole of silver halide to prepare the coating solution for a light-sensitive layer.

a. Spectral sensitizing dye [1] $7.3\times10^{-5}$ mole

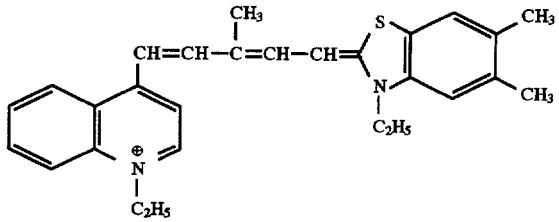

b. Supersensitizer [2]0.42 g

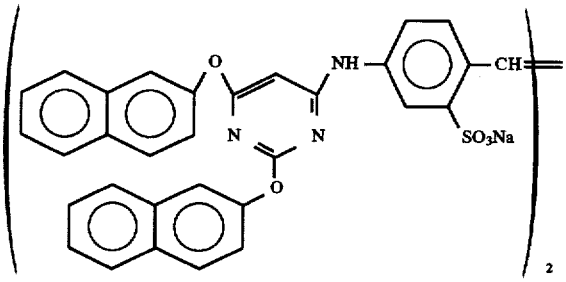

c. Polyacrylamide (molecular weight: $4\times10^4$) 9.2 g d. Trimethylolpropane 1.4 g e. Latex of ethylacrylate/acrylic acid (95/5) copolymer 20 g f. Compound [3] 0.38 g

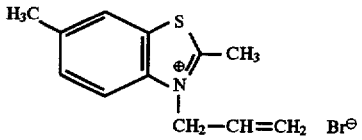

g. Compound [4] 0.085 g

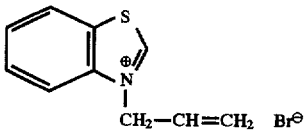

Layer C; Topcoat Layer

In a vessel warmed up to 40° C. were placed the following ingredients in their respective amounts shown below to prepare a coating solution.

| | |
|---|---|
| a. Gelatin | 100 g |
| b. Polyacrylamide (Molecular weight: $4 \times 10^4$) | 8.7 g |
| c. Sodium polystyrenesulfone (molecular weight: $6.0 \times 10^5$) | 0.8 g |
| d. Fine particles of polymethylmethacrylate (average particle size: 2.5 μm) | 2.7 g |
| e. Sodium polyacrylate | 2.6 g |
| f. Sodium t-octylphenoxyethoxyethanesulfonate | 1.6 g |
| g. $C_{16}H_{33}O—(CH_2CH_2O)_{10}—H$ | 3.6 g |
| h. $C_8F_{17}SO_3K$ | 176 mg |
| i. $C_8F_{17}SO_2N(C_3H_7)(CH_2CH_2O)_4(CH_2)_4SO_3Na$ | 88 mg |
| j. NaOH | 0.2 g |
| k. Methanol | 83 ml |
| l. 1,2-bis(vinylsulfonylacetamido)ethane in the proportion of 2.5% by weight to the total gelatin present in the emulsion layer and the surface protecting layer | |
| m. Compound [5] | 56 mg |

in the proportion of 2.52% by weight to the total gelatin present in the emulsion layer and the surface protecting layer m. Compound [5] 56 mg

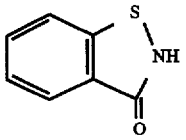

4. Preparation of Coating Solution for Backing Layer

In a vessel warmed up to 40° C. were placed the following ingredients in their respective amounts shown below to prepare a coating solution for a backing layer.

| | |
|---|---|
| a. Gelatin | 100 g |
| b. Dye (A) | 2.1 g |

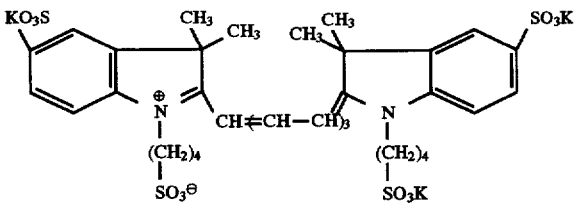

| | |
|---|---|
| C. sodium polystyrene sulfonate | 1.26 g |
| d. Phosphoric acid | 0.4 g |
| e. Latex of ethylacrylate/acrylic acid (95/5) copolymer | 2.2 g |
| f. Compound [5] | 42 mg |
| g. Dye dispersion L described below | 18.7 g |

C. Sodium polystyrenesulfonate 1.26 g d. Phosphoric acid 0.4 g e. Latex of ethylacrylate/acrylic acid (95/5) copolymer 2.2 g f. Compound [5] 42 mg g. Dye dispersion L described below 18.7 g <Preparation of Dye Dispersion L>

A dye (Dye-I) and oils (Oil-I and Oil-II) illustrated below in the amount of 2.5 g each were dissolved in 50 ml of ethyl acetate, and admixed at 60° C. with 90 g of a 8% aqueous gelatin solution containing 1.5 g of sodium dodecylbenzenesulfonate and 0.18 g of methyl p-hydroxybenzoate, followed by high-speed agitation with a homogenizer. The thus agitated matter was evaporated at 60° C. under reduced pressure to remove 92 wt % of the ethyl acetate. Thus, a dye dispersion L having an average particle size of 0.18 μm was obtained.

Dye-I

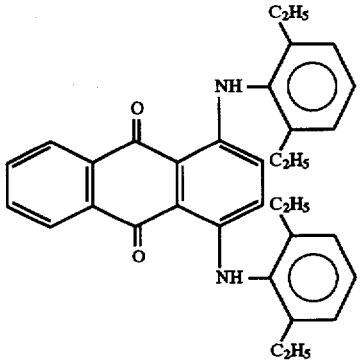

Oil-I Oil-II

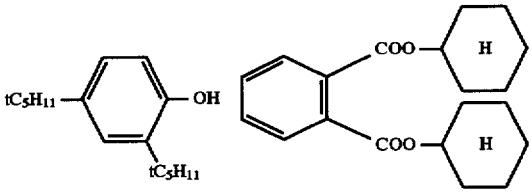

h. Dispersion of Dye (B) in an oil as described in JP-A-61-285445

65 mg (on a dye basis)

Dye (B)

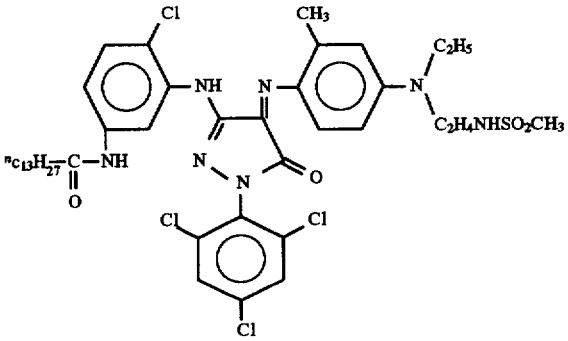

5. Preparation of Coating Solution for Topcoat Layer of Backing Layer

In a vessel warmed up to 40° C. were placed the following ingredients in their respective amounts shown below to prepare a coating solution.

| | |
|---|---|
| a. Gelatin | 100 g |
| b. Sodium polystyrenesulfonate | 0.78 g |
| c. Fine particles of polymethylmethacrylate (average particle size: 3.5 μm) | 4.3 g |
| d. Sodium t-octylphenoxyethoxyethanesulfonate | 2 g |
| e. Sodium polyacrylate | 1.8 g |
| f. $C_{16}H_{33}O—(CH_2CH_2O)_{10}—H$ | 4.05 g |

-continued

| | |
|---|---|
| g. $C_8F_{17}SO_3K$ | 396 mg |
| h. $C_8F_{17}SO_2N(C_3H_7)(CH_2CH_2O)_4(CH_2)_4SO_3Na$ | 52 mg |
| i. NaOH | 0.24 g |
| j. Methanol | 148 ml |
| k. 1,2-bis(vinylsulfonylacetamido)ethane | in the proportion of 2.2% by weight to the total gelatin present in the backing layer and the surface protecting layer |
| l. Compound [5] | 52.5 mg |

6. Preparation of Photographic Materials

To one side of a blue-colored polyethylene terephthalate support, the aforementioned coating solutions for a backing layer and a topcoat layer of a backing layer were applied simultaneously at the gelatin coverage rates of 2.30 g/m$^2$ and 1.02 g/m$^2$, respectively.

Successively thereto, the other side of the support were coated simultaneously with the aforementioned layers A, B and C, which were arranged in that order, to prepare a photosensitive material No. 1. Other photographic materials Nos. 2 to 8 were prepared in the same manner as described above, except that at least either the emulsion comprised in the Layer B or the coverage rate thereof was changed as shown in Table 1.

7. Preparation of Developer and Fixer

<Developer (prepared solution)>

| Ingredient | Amount used (g/l) |
|---|---|
| <Developer (prepared solution)> | |
| Sodium sulfite | 30 |
| Diethylenetriaminepentaacetic acid | 4 |
| Potassium carbonate | 55.2 |
| L-ascorbic acid | 40.1 |
| Potassium bromide | 0.5 |
| 4-hydroxymethyl-4-methyl-1-phenyl-3-pyrazolidone | 1.65 |
| 5-Methylbenzotriazole | 0.6 |
| Acetic acid | 39.3 |
| The pH of the developer was adjusted to 10.0. | |
| <Fixer (prepared solution)> | |
| Sodium thiosulfate pentahydrate | 290 |
| Sodium hydrogen sulfite | 24.6 |
| Disodium ethylenediaminetetraacetate dihydrate | 0.025 |
| Sodium hydroxide | 2.3 |
| The pH of the fixer was adjusted to 5.6. | |

The pH of the fixer was adjusted to 5.6.

8. Observation of Interference fringe i) Exposure to Laser Light in Single-Longitudinal-Mode Each of the photographic materials prepared above was cut into B4 size sheets, underwent the uniform exposure by scanning laser light (laser wavelength: 780 nm) on the emulsion side by means of ML44114N made by Mitsubishi Electric Corp., and subjected to the photographic processing with an automatic developing machine, CEPROS-30, made by Fuji Photo Film Co., Ltd., in which the Dry-to-Dry processing time was set at 30 seconds. Thus, an uniform image having an optical density of 0.4 after the fog density was deduced was formed throughout the light-sensitive material, and examined for interference fringe. An evaluation was made by grading them by the extent of interference fringe in accordance with the criterion described below:

| Criterion of Evaluation | Mark |
|---|---|
| Interference fringe is observed distinctly (so it is on a impractical level) | x |
| Interference fringe is observed faintly | Δ |
| Interference fringe is not observed in a practical sense | 0 |

ii) Exposure to Laser Light in Multi-Longitudinal-Mode

Uniform images were formed in the same manner as described above, except that the exposure was performed using laser light in multi-longitudinal-mode produced by the method of superimposing high frequency waves one upon another as described in JP-A-59-130494.

9. Graininess

Each uniform image having the optical density of 0.4 was exposed to diffuse light (780 nm), and the graininess thereof was evaluated by visual observation.

| Criterion of Evaluation | Mark |
|---|---|
| Graininess is on a satisfactory level | 0 |
| Graininess is on an average (practically allowable) level | Δ |
| Graininess is on an unsatisfactory level | x |

10. Fixability

In the photographic processing described above, the temperature of the fixer was maintained at 18° C., and the washing temperature was set at 7° C. Each image obtained under such a condition was examined for fixability in the Dmin area.

| Criterion of Evaluation | Mark |
|---|---|
| Fixability is on a satisfactory level | 0 |
| Fixability is somewhat poor, but on allowable level | Δ |
| Fixability is on an unsatisfactory level | x |

TABLE 1

| Test No. | Laser Mode | Sample No. | Emulsion No. | Grain Size of AgX | Ag Coverage of AgX | Graininess | Interference Fringe | Processability (Fixability) |
|---|---|---|---|---|---|---|---|---|
| 1 (invention) | multi longitudinal | 1 | 1A | 0.05 μm | 0.9 g/m$^2$ | ○ | ○ | ○ |
| 2 (invention) | multi longitudinal | 2 | 2A | 0.12 μm | 0.9 g/m$^2$ | ○ | ○ | ○ |
| 3 | multi | 3 | 3A | 0.4 μm | 0.9 g/m$^2$ | x | ○ | ○ |

TABLE 1-continued

| Test No. | Laser Mode | Sample No. | Emulsion No. | Grain Size of AgX | Ag Coverage of AgX | Graininess | Interference Fringe | Processability (Fixability) |
|---|---|---|---|---|---|---|---|---|
| (comparison) 4 | longitudinal multi | 4 | 4A | 1 μm | 0.9 g/m² | x | ○ | ○ |
| (comparison) 5 | longitudinal multi | 5 | 1A | 0.05 μm | 2.0 g/m² | ○ | ○ | x |
| (comparison) 6 | longitudinal multi | 6 | 2A | 0.12 μm | 2.0 g/m² | ○ | ○ | x |
| (comparison) 7 | longitudinal multi | 7 | 3A | 0.4 μm | 2.0 g/m² | ○ | ○ | x |
| (comparison) 8 | longitudinal multi | 8 | 4A | 1 μm | 2.0 g/m² | ○ | ○ | x |
| (comparison) 9 | longitudinal single | 1 | 1A | 0.05 μm | 0.9 g/m² | ○ | x | ○ |
| (invention) 10 | longitudinal single | 2 | 2A | 0.12 μm | 0.9 g/m² | ○ | x | ○ |
| (invention) 11 | longitudinal single | 3 | 3A | 0.4 μm | 0.9 g/m² | x | x | ○ |
| (comparison) 12 | longitudinal single | 4 | 4A | 1 μm | 0.9 g/m² | x | Δ | ○ |
| (comparison) 13 | longitudinal single | 5 | 1A | 0.05 μm | 2.0 g/m² | ○ | x | x |
| (comparison) 14 | longitudinal single | 6 | 2A | 0.12 μm | 2.0 g/m² | ○ | ○ | x |
| (comparison) 15 | longitudinal single | 7 | 3A | 0.4 μm | 2.0 g/m² | ○ | ○ | x |
| (comparison) 16 | longitudinal single | 8 | 4A | 1 μm | 2.0 g/m² | ○ | ○ | x |
| (comparison) | longitudinal | | | | | | | |

As can be seen from Table 1, the present method for image formation was superior.

EXAMPLE 2

1. Preparation of Silver Behenate A

Gelatin (which had received an ion exchange treatment) in the amount of 73 g was added to 1,000 ml of water and dissolved therein by heating at 50° C. Thereto was added 31 g of behenic acid, and it was heated at 90° C. to dissolve the behenic acid therein. Further, the resulting solution was admixed with 39 ml of 1N NaOH and 2 g of $NaCO_2$, and stirred for 4 minutes at 12,000 r.p.m. by means of a homogenizer. Thus, a monodisperse fine grain dispersion of behenic acid/sodium behenate mixture was obtained. The dispersion thus obtained was heated to 50° C., adjusted to pH 7 with $HNO_3$, and then admixed with 0.1 g of N-bromosuccinimide. Thereto was added a solution of 12 g of silver nitrate in 47 ml of water over a 5-minute period with stirring at 1,200 r.p.m. After cooling down to 35° C., the resulting reaction mixture was subjected to a desalting treatment with a flocculant, admixed with gelatin (which had undergone an ion exchange treatment) and then adjusted to pH 6 with NaOH. Thus, an intended silver behenate Dispersion A was prepared.

2. Preparation of Coated Samples

Layer A;

Gelatin (not yet subjected to 1 g/m² any ion exchange treatment)

Dye I-1 illustrated below 10 mg/m²

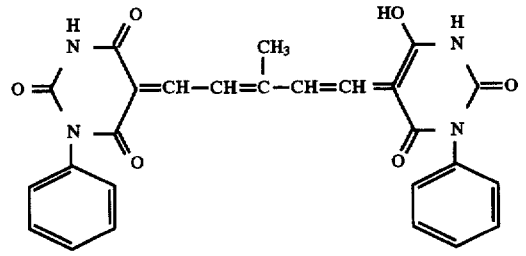

Layer B: Light-sensitive Layer

| | |
|---|---|
| Silver behenate Dispersion A | 3 g/m², based on Ag |
| Silver halide emulsion as described in Example 1 | Amount shown in Table 2 |
| Spectral sensitizing dye [1] | $2 \times 10^{-7}$ mole |
| Supersensitizer [2] | 1 mg |
| Trimethylolpropane | 39 mg |
| Sodium benzenesulfinate | 4 mg |
| Phthalazinone | 200 mg |
| Reducing agent | 800 mg |

Spectral sensitizing dye [1]

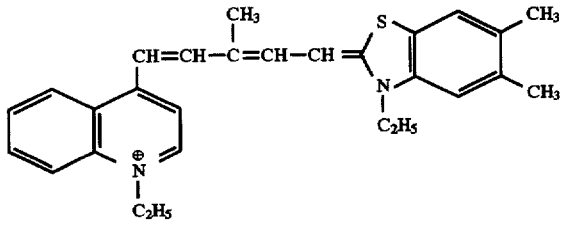

Supersensitizer [2]

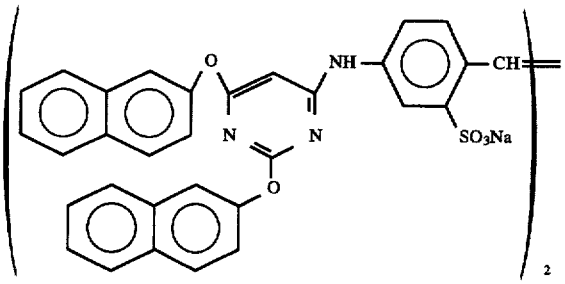

Reducing Agent

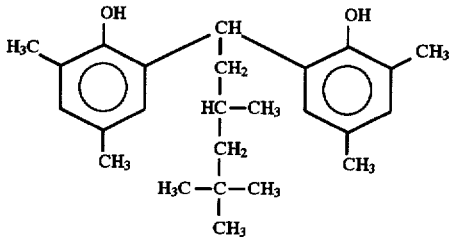

Layer C; Topcoat Layer

| | |
|---|---|
| Gelatin (having received an ion exchange treatment | 0.6 g/m$^2$ |
| Polymethylmethacrylate (average particle size: 2.5 μm) | 27 mg/m$^2$ |
| Sodium t-octylphenoxyethoxyethanesulfonate | 16 mg/m$^2$ |
| $C_{16}H_{33}O—(CH_2CH_2O)_{10}—H$ | 36 mg |
| $C_8F_{17}SO_3K$ | 1.76 mg |
| $C_8F_{17}SO_2N(C_3H_7)(CH_2CH_2O)_4(CH_2)_4SO_3Na$ | 0.88 mg |
| NaOH | 2 mg |
| Methanol | 0.83 ml |
| 1,2-bis(vinylsulfonylacetamido)ethane | in the proportion of 2.5% by weight to the total gelatin present in the photosensitive layer and the topcoat layer |
| Compound [5] | 56 mg |

in the proportion of 2.5% by weight to the total gelatin present in the photosensitive layer and the topcoat layer Compound [5] 56 mg

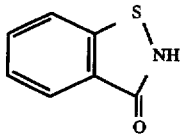

3. Preparation of Coating Solution for Backing Layer: In a vessel warmed up to 40° C. were placed the following ingredients in their respective amounts shown below to prepare a coating solution for a backing layer.

| | |
|---|---|
| a. Gelatin | 100 g |
| b. Dye (A) | 2.1 g |

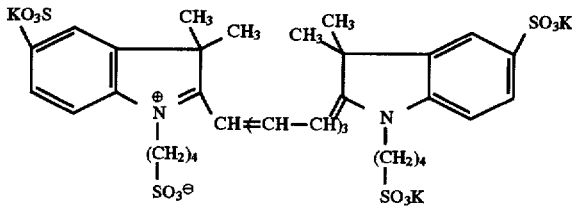

| | |
|---|---|
| c. Sodium polystyrenesulfonate | 1.26 g |
| d. Phosphoric acid | 0.4 g |
| e. Latex of ethylacrylate/acrylic acid (95/5) copolymer | 2.2 g |
| f. Compound [5] | 42 mg |
| g. Dye dispersion L described below | 18.7 g |

<Preparation of Dye Dispersion L>

A dye (Dye-I) and oils (Oil-I and Oil-II) illustrated below in the amount of 2.5 g each were dissolved in 50 ml of ethyl acetate, and admixed at 60° C. with 90 g of a 8% aqueous gelatin solution containing 1.5 g of sodium dodecylbenzenesulfonate and 0.18 g of methyl p-hydroxybenzoate, followed by high-speed agitation with a homogenizer. The thus agitated matter was evaporated at 60° C. under reduced pressure to remove 92 wt % of the ethyl acetate. Thus, a dye dispersion L having an average particle size of 0.18 μm was obtained.

Dye-I

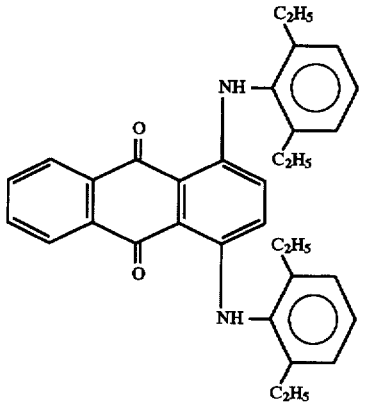

Oil-I Oil-II

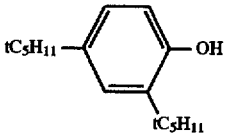

-continued

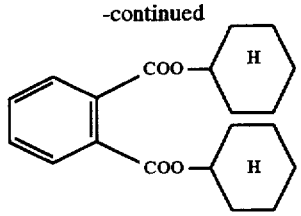

h. Dispersion of Dye (B) in an oil as described in JP-A-61-285445
65mg (on a dye basis)
Dye (B)

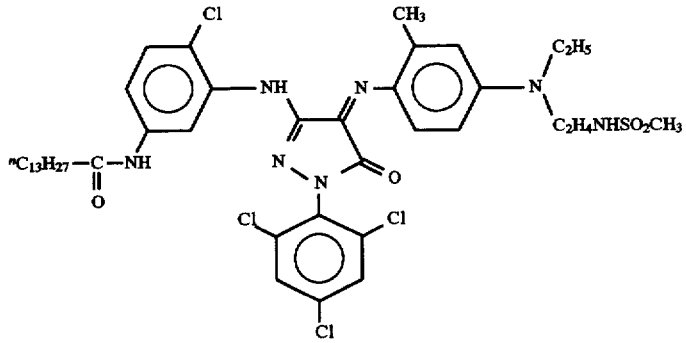

4. Preparation of coating Solution for Topcoat Layer of Backing Layer:

In a vessel warmed up to 40° C. were placed the following ingredients in their respective amounts shown below to prepare a coating solution.

| | |
|---|---|
| a. Gelatin | 100 g |
| b. Sodium polystyrenesulfonate | 0.78 g |
| c. Fine particles of polymethylmethacrylate (average particle size: 3.5 μm) | 4.3 g |
| d. Sodium t-octylphenoxyethoxyethanesulfonate | 2 g |
| e. Sodium polyacrylate | 1.8 g |
| f. $C_{16}H_{33}O—(CH_2CH_2O)_{10}—H$ | 4.05 g |
| g. $C_8F_{17}SO_3K$ | 396 mg |
| h. $C_8F_{17}SO_2N(C_3H_7)(CH_2CH_2O)_4(CH_2)_4SO_3Na$ | 52 mg |
| i. NaOH | 0.24 g |
| j. Methanol | 148 ml |
| k. 1,2-bis(vinylsulfonylacetamido)ethane | in the proportion of 2.2% by weight to the total gelatin present in the backing layer and the surface protecting layer |
| l. Compound [5] | 52.5 mg |

in the proportion of 2.2% by weight to the total gelatin present in the backing layer and the surface protecting layer 1. Compound [5] 52.5 mg 5. Preparation of Photographic Materials To one side of a blue-colored polyethylene terephthalate support, the aforementioned coating solutions for a backing layer and a topcoat layer of a backing layer were applied simultaneously at the gelatin coverage rates of 2.30 g/m$^2$ and 1.02 g/m$^2$, respectively.

Successively thereto, the other side of the support were coated simultaneously with the aforementioned layers A, B and C, which were arranged in that order. Thus, intended photographic materials as shown in Table 2 were prepared.

Additionally, the phtalazone and the reducing agent were incorporated in Layer B as a fine grain dispersion prepared in the following manner: The phtalozone and the reducing agent each in the amount of 2.5 g were mixed with 3 g of a 25% aqueous solution of W-1 (Demohr SNB, trade name, a product of Kao Corp.) and 57.8 g of water with stirring. Then, the mixture was placed in a sand grinder mill (1/16 G, made by Aimex Co., Ltd.) in which 100 cc of glass beads measuring from 0.8 mm to 1.2 mm in diameter were kept, and dispersed at 1,800 r.p.m. W-1

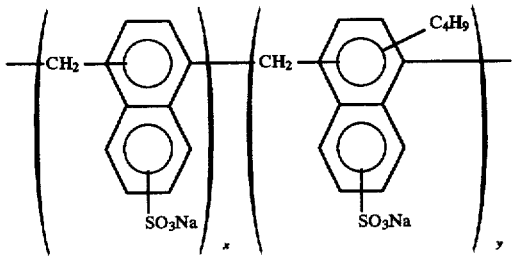

x:y = 4:1

6. Observation of Interference Fringe

The extent of interference fringe was evaluated by the same method as in Example 1, except that the exposure and the processing adopted herein were as follows;

Exposure i) Exposure to Laser Light in Single-Longitudinal-Mode

The same exposure was conducted as in Example 1 (laser wavelength: 780 nm)

ii) Exposure to Laser Light in Multi-Longitudinal-Mode

The same exposure was conducted as in Example 1 (laser wavelength: 780 nm) except for using a multi-longitudinal-mode laser diode, ML40110R, made by Mitsubishi Electric Corp.

Processing

After exposure, heat development was carried out at 120° C. for 5 seconds by means of a heat drum.

7. Graininess

The graininess of each image having the optical density of 0.4 was examined in the same way as in Example 1 and evaluated by visual observation according to the same criterion as in Example 1.

8. Image Stability

The Dmin area after the processing was allowed to stand for one day under white light, and examined for the extent of stain generated therein.

| Criterion of Evaluation | Mark |
|---|---|
| Stain is slight enough to be allowable | 0 |
| Stain is so distinct as to be improper to practical purpose | x |

TABLE 2

| Test No. | Laser Mode | Sample No. | Emulsion No. | Grain Size of AgX | Ag Coverage of AgX | Graininess | Interference Fringe | Image Stability |
|---|---|---|---|---|---|---|---|---|
| 21 (invention) | multi longitudinal | 11 | 1 | 0.05 μm | 0.75 g/m² | ○ | ○ | ○ |
| 22 (invention) | multi longitudinal | 12 | 2 | 0.12 μm | 0.75 g/m² | ○ | ○ | ○ |
| 23 (comparison) | multi longitudinal | 13 | 3 | 0.4 μm | 0.75 g/m² | x | ○ | ○ |
| 24 (comparison) | multi longitudinal | 14 | 4 | 1 μm | 0.75 g/m² | x | ○ | ○ |
| 25 (comparison) | multi longitudinal | 15 | 1 | 0.05 μm | 2.0 g/m² | ○ | ○ | x |
| 26 (comparison) | multi longitudinal | 16 | 2 | 0.12 μm | 2.0 g/m² | ○ | ○ | x |
| 27 (comparison) | multi longitudinal | 17 | 3 | 0.4 μm | 2.0 g/m² | ○ | ○ | x |
| 28 (comparison) | multi longitudinal | 18 | 4 | 1 μm | 2.0 g/m² | ○ | ○ | x |
| 29 (invention) | single longitudinal | 11 | 1 | 0.05 μm | 0.75 g/m² | ○ | x | ○ |
| 30 (invention) | single longitudinal | 12 | 2 | 0.12 μm | 0.75 g/m² | ○ | x | ○ |
| 31 (comparison) | single longitudinal | 13 | 3 | 0.4 μm | 0.75 g/m² | x | x | ○ |
| 32 (comparison) | single longitudinal | 14 | 4 | 1 μm | 0.75 g/m² | x | Δ | ○ |
| 33 (comparison) | single longitudinal | 15 | 1 | 0.05 μm | 2.0 g/m² | ○ | x | x |
| 34 (comparison) | single longitudinal | 16 | 2 | 0.12 μm | 2.0 g/m² | ○ | ○ | x |
| 35 (comparison) | single longitudinal | 17 | 3 | 0.4 μm | 2.0 g/m² | ○ | ○ | x |
| 36 (comparison) | single longitudinal | 18 | 4 | 1 μm | 2.0 g/m² | ○ | ○ | x |

As can be seen from Table 2, the present method for image formation was superior.

While the invention has been described in detail and with reference to specific embodiments thereof, it will be apparent to one skilled in the art that various changes and modifications can be made therein without departing from the spirits and scope thereof.

What is claimed is:

1. A method for forming an image, comprising the step of subjecting a light-sensitive material to exposure to laser light having a multi-longitudinal-mode, wherein said light-sensitive material comprises a support having provided thereon a layer comprising light-sensitive silver halide grains having an average grain size of no greater than 0.1 μm, the light-sensitive silver halide grains being present in a coverage rate of no greater than 1 g/m², based on silver, wherein said light-sensitive material contains (i) a silver salt of a long-chain fatty acid, (ii) an organic reducing agent, or (iii) a toning agent with the light-sensitive silver halide grains and, wherein said light-sensitive material is spectrally sensitized in a wavelength of from red to infrared radiation.

2. The method as claimed in claim 1, further comprising the step of subjecting said light-sensitive material to heat development after the exposure.

3. The method as claimed in claim 1, wherein the light-sensitive silver halide grains have an average grain size of 0.0001 μm to 0.1 μm.

4. The method as claimed in claim 1, wherein the light-sensitive silver halide grains have an average grain size of 0.001 μm to 0.1 μm.

5. The method as claimed in claim 1, wherein the light-sensitive silver halide grains have a coverage rate of 0.005 g/m² to 1 g/m², based on silver.

6. The method as claimed in claim 1, wherein the light-sensitive silver halide grains have a coverage rate of 0.005 g/m² to 0.2 g/m², based on silver.

7. The method as claimed in claim 1, wherein said light-sensitive material has maximum spectral sensitivity at a wavelength no shorter than 700 nm by using a sensitizing dye represented by formula (Ia), (Ib) or (Ic):

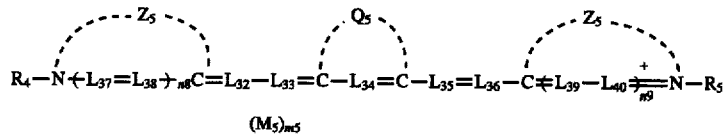

(Ia)

-continued

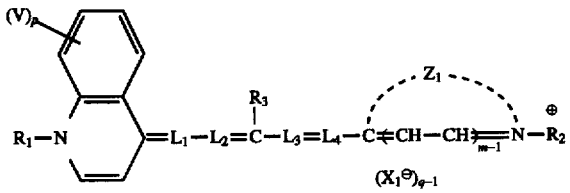

(Ib)

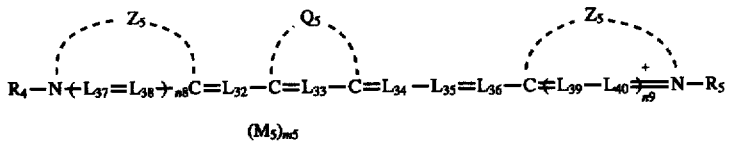

(Ic)

wherein $Z_5$ and $Z_6$ each represents an atomic group necessary for forming a 5- or 6-membered nitrogen-containing heterocyclic ring; $Q_5$ represents an atomic group necessary for forming a 5-, 6- or 7-membered ring; $R_4$ and $R_5$ each represents an alkyl group; $L_{32}$, $L_{33}$, $L_{34}$, $L_{35}$, $L_{36}$, $L_{37}$, $L_{38}$, $L_{39}$ and $L_{40}$ each represents an unsubstituted or substituted methine group, and any one of $L_{32}$, $L_{33}$, $L_{34}$, $L_{35}$, $L_{36}$, $L_{37}$, $L_{38}$, $L_{39}$ and $L_{40}$ may form a ring together with another methine group or an auxochrome; $n_8$ and $n_9$ are each 0 or 1; $M_5$ represents a counter ion for charge neutralization; $m_5$ is the number of counter ion(s) required for neutralization of intramolecular charges, which is not smaller than 0; $R_1$ and $R_2$ are the same or different, and each represents an alkyl group; $R_3$ represents a hydrogen atom, a lower alkyl group, a lower alkoxy group, a phenyl group, a benzyl group or a phenetyl group; $L_1$, $L_2$, $L_3$ and $L_4$ are each an unsubstituted or substituted methine group, and $L_2$ and $L_3$ may combine with each other to complete a ring; V represents a hydrogen atom, a lower alkyl group, an alkoxy group, an alkylthio group, a halogen atom, or a substituted alkyl group; $Z_1$ represents a nonmetallic atomic group necessary for completing a 5- or 6-membered nitrogen-containing heterocyclic ring; $X_1$ represents an acid anion; m, p and q independently represent 1 or 2, and when q is 1, the dye represented by formula (Ib) forms an inner salt.

8. The method as claimed in claim 1, wherein said light-sensitive material contains a water-soluble iridium compound in an amount of $10^{-8}$ mole per mole of silver halide.

9. The method as claimed in claim 8, wherein said light-sensitive material contains a water-soluble iridium compound in an amount of $1\times10^{-8}$ to $1\times10^{-5}$ mole per mole of silver halide.

* * * * *